United States Patent [19]

Graham et al.

[11] Patent Number: 4,551,930

[45] Date of Patent: Nov. 12, 1985

[54] SOLE CONSTRUCTION FOR FOOTWEAR

[75] Inventors: Kenneth W. Graham, Wakefield; Edward J. Norton, Ipswich, both of Mass.; Shuhei Kurata, Fukuoka, Japan

[73] Assignee: New Balance Athletic Shoe, Inc., Lawrence, Mass.

[21] Appl. No.: 535,288

[22] Filed: Sep. 23, 1983

[51] Int. Cl.[4] ..... A43B 13/14; A43B 13/18; A43B 13/04

[52] U.S. Cl. ..... 36/30 R; 36/32 R; 36/37; 36/114

[58] Field of Search ..... 36/30 R, 30 A, 32 R, 36/31, 37, 28, 114, 129, 44, 69, 104; 12/146 BR, 146 B, 142 RS; 264/244; 425/129 S

[56] References Cited

U.S. PATENT DOCUMENTS

| | | | |
|---|---|---|---|
| 2,055,574 | 9/1936 | Hartl . | |
| 2,911,973 | 11/1959 | Chieffo . | |
| 3,742,622 | 7/1973 | Dassler . | |
| 4,128,950 | 12/1978 | Bowerman et al. | 36/30 R |
| 4,217,705 | 8/1980 | Donzis . | |
| 4,228,600 | 10/1980 | Krug et al. | 36/30 R |
| 4,255,877 | 3/1981 | Bowerman | 36/129 |
| 4,297,796 | 11/1981 | Stirtz et al. | 36/30 R |
| 4,297,797 | 11/1981 | Meyers | 36/44 |
| 4,302,892 | 12/1981 | Adamik | 36/31 |
| 4,316,332 | 2/1982 | Giese et al. . | |
| 4,354,318 | 10/1982 | Frederick et al. | 36/30 R |
| 4,364,188 | 12/1928 | Turner et al. | 36/32 R |
| 4,364,189 | 12/1982 | Bates . | |

FOREIGN PATENT DOCUMENTS

| | | | |
|---|---|---|---|
| 0096819 | 6/1983 | European Pat. Off. . | |
| 0103285 | 9/1983 | European Pat. Off. . | |
| 0108278 | 10/1983 | European Pat. Off. . | |
| 0111084 | 10/1983 | European Pat. Off. . | |
| 2107447 | 8/1972 | Fed. Rep. of Germany . | |
| 2751146 | 5/1979 | Fed. Rep. of Germany . | |
| 2904540 | 8/1980 | Fed. Rep. of Germany . | |
| 3021129 | 2/1981 | Fed. Rep. of Germany . | |
| 3029258 | 4/1982 | Fed. Rep. of Germany . | |
| 3233792 | 3/1984 | Fed. Rep. of Germany . | |
| 3245964 | 6/1984 | Fed. Rep. of Germany . | |
| 2522482 | 9/1983 | France | 36/28 |
| 50-30935 | 4/1975 | Japan . | |
| 55-55817 | 4/1980 | Japan | 264/244 |
| 2007081 | 5/1979 | United Kingdom | 36/32 R |

*Primary Examiner*—James Kee Chi

*Attorney, Agent, or Firm*—Pennie & Edmonds

[57] ABSTRACT

A sole unit for footwear such as an athletic shoe includes an integral midsole/wedge or a wedge for use with a midsole. The integral midsole/wedge unit and the wedge for use with a midsole both are formed by a shell and an encapsulated core. The shell and core comprise plastic materials which have individual strengths and weaknesses in a shoe construction, yet provide, as a composite improved results in a shock dispersion and memory system. In a second aspect, the integral midsole/wedge is a single density or a two-density unit precompressed from a low density material.

25 Claims, 13 Drawing Figures

SOLE CONSTRUCTION FOR FOOTWEAR

DESCRIPTION

1. Technical Field

The invention relates to footwear, such as athletic shoes and particularly athletic shoes for runners, joggers and the like. In its more specific aspect, the invention relates to a sole unit for an athletic shoe which imparts to the footwear a significant measure of enhancement, at least, in a capability of dispersion of shock and in an improved memory characteristic.

2. Background of the Invention

Over the years there have been many attempts to construct a sole unit for an athletic shoe to meet varying requirements of feel, function and support as well as to construct the sole unit of varying materials. To this end, there have been attempts to provide a sole unit for better memory and dispersion of shock during running, as well as to meet other demands of various running groups.

One suggestion for improving a sole unit described by the prior art related to the encapsulation by polyurethane of an air bag filled with an inert gas, such as nitrogen. Thus, it was the intention of the prior art to provide a sole unit which would retain certain desired characteristics imparted by the polyurethane material comprising the shell surrounding the air bag; and, at the same time, to impart from the core of the sole unit other characteristics not obtained by a midsole formed entirely of polyurethane.

While an athletic shoe of the described type may provide many desired and sought-after results, the athletic shoe of the present invention is considered to be an improvement over the known prior art.

SUMMARY OF THE INVENTION

The invention is in a midsole for a sole unit for footwear, such as an athletic shoe, including a combined midsole and wedge construction. In a first form, the midsole comprises a construction formed by an encapsulated core and a surrounding shell, with both the core and shell being formed of plastic materials which both individually and collectively enhance the overall functioning of the midsole.

In a first form, the midsole includes a core formed of ethylene-vinyl acetate polymer and a shell formed of polyurethane. These chemically non-compatible plastic materials, each of which have distinct advantages and disadvantages with regard to their use in an athletic shoe, have been found to unexpectedly and uniquely complement one another to provide what is considered a revolutionary shock dispersion and memory system. Further, the midsole has been found to vastly extend to protective life of the sole unit by virtually eliminating the compression that results from the use of a prior art midsole formed solely of ethylene-vinyl acetate polymer, and by adding unique damping or shock attentuation properties by virtue of the shell of polyurethane. The core of ethylene-vinyl acetate polymer provides the function of weight relief and "bounce" or spongy feel desired by runners, as opposed to the dead feel of a full polyurethane sole unit.

The sole unit may include a shell that completely encases the core throughout the top and bottom surfaces, and along the sides. The sole unit, also, may include a shell that similarly completely encases the core except throughout the top surface at the forepart of the midsole.

The shell, within the region of the core of the midsole that it covers, along the top and bottom surfaces, will have a thickness within the range of 2–3 mm ±, a small tolerance factor, and a somewhat greater thickness along the front, back and sidewalls which varies because of angles of the bevels and flares.

In the form of midsole wherein the shell completely encases the core the thickness of the shell along the top and bottom surface generally will taper from the heel toward the forepart. In the form of midsole wherein the shell substantially completely encases the core, the shell may taper similarly along the top surface and have a reverse taper along the bottom surface. In this manner the resultant widths of these midsoles at the forepart will be substantially equal. The plastic materials of the shell and core may be of varying durometer (Shore A). For example, the polyurethane may be of 20–40 durometer, and the ethylene-vinyl acetate polymer may be 25–40 durometer.

In a second form of the invention, the midsole may comprise either a single density or double density plastic materials, wherein the midsole is molded from a low density to a high density form. In a preferred form of the invention, the midsole is of ethylene vinyl acetate having a low density, and molded to a higher density which will have a durometer (Shore A) of from 25–40. The density may be as low as 15. It has been found, that the molding process not only changes the cell structure of the plastics material from low to high density, it also provides the benefit of forming an integral skin around the midsole. Of possibly greater importance, however, compression molding of the plastics material lowers the compression set of the plastic materials without loss of the bouncy feel and lightweightness. This result is believed to follow from the fact that the cell structure of the plastic materials is compressed in molding, to provide significant improvement over prior art, single density, non-molded midsoles. The double density midsole will include a forepart of a first plastic material and either a heel pad or heel of a second like plastics material, although of somewhat higher relative density. The heel pad may extend throughout the heel surface or the heel pad may be of somewhat horseshoe outline having a longer leg along the medial side of the midsole. It has been found that the higher density buffer pad tends to better regulate the compression set.

In a further form of the invention, the sole unit of the footwear may include a wedge unit having a shell and an encapsulated core. The construction of wedge of this form of the invention generally follows that of the midsole including a completely encapsulated core, and the durometer of the plastics materials may be as previously discussed. Further, the core, within the region of the heel, may be of an outline generally like that of the heel, or the core may be of an horseshoe outline having the longer leg along the medial side of the athletic shoe.

Other features and advantages of the invention will become clear as the description continues.

BEST MODE FOR CARRYING OUT THE INVENTION

Figure 1:
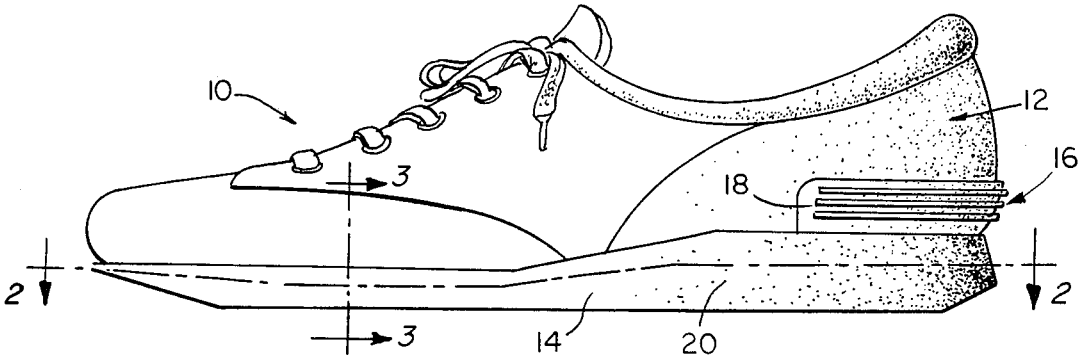
FIG. 1 is a side elevation of an athletic shoe of the invention.

The footwear 10 of the invention in the form of an athletic shoe (hereafter "shoe") may be seen in FIG. 1. The shoe typically is of the type used by runners, joggers and the like and structurally may generally be characterized as including a lasted upper 12 providing a foot receiving opening, eyelets along the opening for securing laces, a sole unit 14 and a stabilizer 16 supported on the sole unit to extend partially around the upper. While the shoe illustrated in FIG. 1 is of the so-called low-cut variety, the concepts of the invention have a wider application and may be used with other types of shoes, as well.

The sole unit is formed by a midsole and an outsole (not shown) providing a running surface formed with a pattern of ridges extending across the shoe from the medial to the lateral side for gripping a surface, or a running surface of any other design, as may be desired. In one aspect of the invention, the midsole comprises an integral midsole/wedge construction, and in a second aspect of the invention the midsole comprises a separable midsole and wedge. In both aspects of the invention, the sole unit may also include an insole (not shown) disposed above the integral or separable midsole/-wedge, as the case may be. The several components of the sole unit are mounted and secured together according to conventional practices in the art.

Before turning to a discussion of the sole unit and the aspects of the invention discussed above, reference may be had to FIG. 1 and stabilizer 16 illustrated in that Figure. Although not fully shown, the stabilizer extends around the rear of the heel of the shoe and forwardly of the heel, on both the medial and lateral sides of the shoe, toward the region of the ankles of the foot. The stabilizer includes a wall 18 which extends upward from a base (not shown) to a point below the region of each ankle. The base will be supported by the sole unit, and the wall preferably will extend further forward from the rear of the heel on the medial side of the shoe.

Stabilizer 16 may be formed of various plastic materials, such as polyurethane and nylon, and may have an overall thickness of wall in the range of about 1.5 to 2.0 mm. The choice of material may be determined by desired characteristics such as pliability. According to this criteria nylon would be preferred if a more rigid stabilizer were desired. These materials may have a density (Shore A) of about 75–95, and the stabilizer may weigh about 17 grams. The stabilizer provides the function of the control in the manner described in U.S. Pat. No. 4,288,929 to E. J. Norton. To this end, the stabilizer provides a mechanical control to hold the foot of the runner securely in the neutral plane, that is, the natural position of the foot while in motion in a normal gait cycle. The stabilizer will reduce the amount of toll of the foot which otherwise may result in or be the cause of, running related injury to the foot, ankle, knee, and so forth. Other features of the stabilizer may be gleaned through consideration of the patent.

Figure 2:
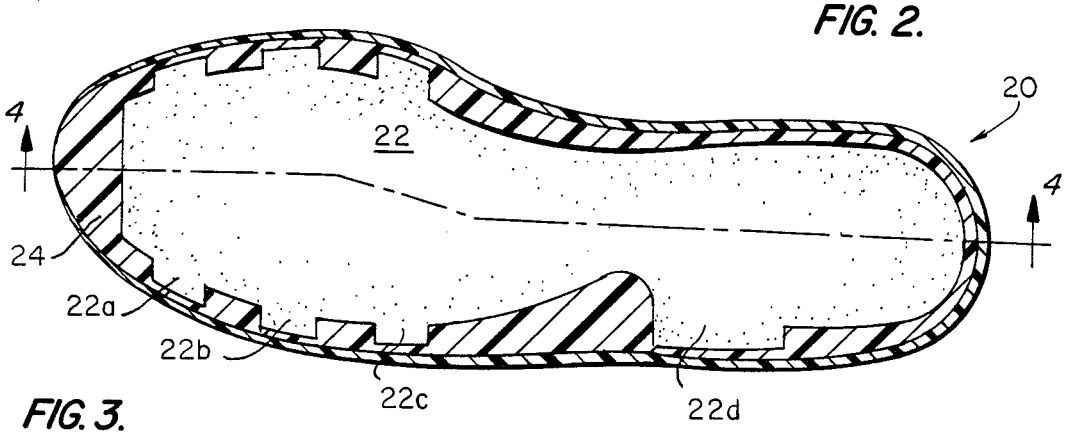
FIG. 2 is a view taken along the line 2—2 in FIG. 1, illustrating the midsole (left) of a sole unit.
Figure 3:
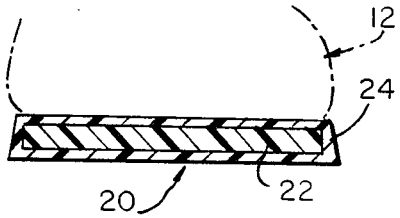
FIG. 3 is a view taken along the line 3—3 in FIG. 1.
Figure 4:
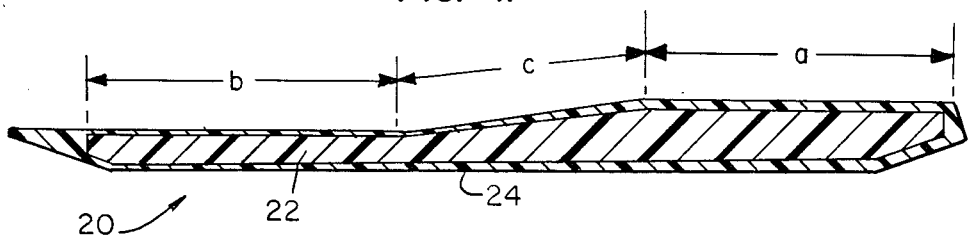
FIG. 4 is a view taken along the line 4—4 in FIG. 2 illustrating an encapsulated core.

Referring to the first aspect of the invention, see FIG. 2, a first form of integral midsole/wedge (hereafter "midsole") 20 comprises a core 22 and a jacket or shell 24. The shell, referring also to FIGS. 3 and 4, provides complete encapsulation. In a preferred embodiment of the invention, the midsole includes a core of ethylene-vinyl acetate polymer (EVA) and a shell of polyurethane (PU).

The materials of the core and shell each have distinct advantages and disadvantages with regard to their use in the construction of a midsole for a sole unit, such as the sole unit 14. To this end, the encapsulation of the EVA core by a PU shell may be described as the complementary integration of two chemically non-compatible materials to complement one another for use in a midsole, and provide significant improvement over prior art athletic shoes in the shock dispersion and memory system. In addition, it has been found that the encapsulation of EVA/PU extends the protective life of the sole unit, first, by virtually eliminating the compression that results in the singular use in a midsole of EVA, and, second, by adding to the midsole unique damping or shock attenuation properties which derive from the shell 24 of polyurethane. Further, the core 22 within shell 24 provides the weight relief and "bounce" or spongy feel that a runner desires as opposed to the dead feel of a midsole formed totally of polyurethane.

The shell 24 of midsole 20 may vary in thickness throughout and along the top and bottom regions of core 22. Without any intent to limit the invention, but rather to more particularly described what may be considered a preferred embodiment thereof, the shell may vary in thickness from a thickness of 2 mm±1 at the rear or heel, throughout both the top and bottom, to a thickness of about 0.5 mm at the forepart or ball. The wall of the shell, including the rear wall and side walls, may be considerably thicker than the shell along both the top and bottom. This increased thickness, which may be an increase possibly of several fold, will assist in retention of the integrity of the core and overcome any possible problem of the core material delaminating. As may be seen in FIGS. 3 and 4, the shell will be thicker at the base of the midsole. This is because of outward bevel or taper around the rear wall and along the side walls which may have an angle of about 8°. As may be seen in FIG. 2, the irregular shape of the core (in plan view), as will be discussed, results in considerable variation in thickness along the medial and lateral sides of the midsole.

Referring to FIG. 4, the thickness of shell 24 at the top will be about 2 mm±1 along the region a, about 0.5 mm±a tolerance factor along the region b, and of a gradually decreasing thickness along the region c. The thickness of the shell at the bottom gradually decreases from the maximum to the minimum thickness. The core 22 also varies in thickness from the heel to the forepart of the midsole. For example, the core may be about 19 mm thick at the heel and about 10 mm thick in the forepart. The overall shape of the midsole is tapered upwardly at both the forepart and heel to accommodate the outsole of the sole unit.

Referring to FIG. 2, core 22 includes a plurality of regions *22a*, *22b*, . . . in the forepart of the midsole 20, oppositely directed from the main body of the core toward the side walls, and a region *22d* (there could be an oppositely directed region, as well) in the rear of the midsole and likewise directed from the main body of the core toward the side walls. The regions *22a*, *22b*, . . . *22d* add a measure of flexibility to the midsole 20, and as will be discussed assist in the overall molding operation during which the shell is molded about the core.

Figure 4A:
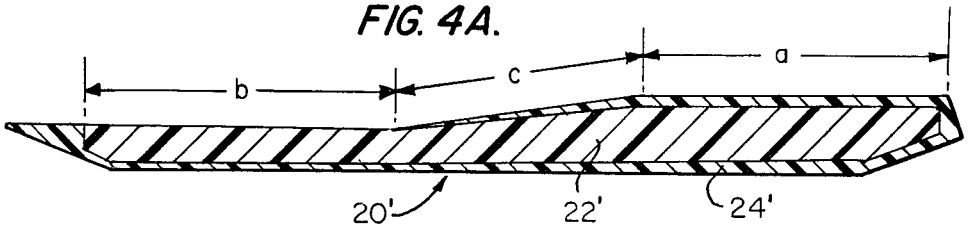
FIG. 4A is a view like that of FIG. 4 illustrating a midsole of slightly modified form.

Referring to FIG. 4A, there is illustrated a modified form of midsole 20' including a core 22' and a shell 24'. This variation in the midsole includes a core which is exposed throughout the top surface within the region *b*. In this form of midsole which may be preferred because the midsole construction lends itself to more consistent manufacturing techniques, the core will vary in thickness from about 19 mm at the rear to about 8 mm at the forepart. The shell, also, may vary in thickness from the rear to the forepart of the shoe. To this end the shell has a thickness of 2 mm±1 at the top (within the region a). The thickness of the shell at the bottom rear is also 2 mm±1. The shell will be gradually tapered along the bottom surface to a thickness of 3 mm±1 at the forepart of the shoe. The thickness of the side walls and rear wall may be as previously discussed.

The polyurethane which has been used successfully in the practice of the invention is designated as AT-40 (available from Kao Soap Company, Ltd., Wayayama, Japan), while the ethylene-vinyl acetate polymer is designated T1350 (available from Heiwa Rubber Ind. Co., Ltd., Kobe, Japan). A definitive specification for these materials, molded in a mold, set out in Table I.

TABLE I

| Characteristic | AT-40 | T1350 |
|---|---|---|
| Specific gravity | 0.35 | 0.17 |
| Hardness, Shore A | 38 | 25 |
| Tensile Strength | 40 kg/cm$^2$ | 20 kg/cm$^2$ |
| Elongation (at break) | 450% | 220% |
| Tear Resistance | 14 kg/cm$^2$ | 7 kg/cm$^2$ |
| Compression Set | 12% | 58% |

Polyurethane and ethylene-vinyl acetate polymer having different hardness and density characteristics also may be used, as determined by the use criteria to be met. Thus, the EVA may display a durometer reading (Shore A) of 30, 35 and 40 in the practice of the invention. Similarly, the polyurethane may be a polyurethane designated as AT-20 having a durometer reading (Shore A) of about 20.

In Table II, below, specifications are set out for a molded polyurethane when molded in a mold including an EVA fore.

TABLE II

| Characteristic | AT-40/EVA |
|---|---|
| Specific gravity | 0.55 |
| Hardness, Shore A | 45 |
| Tensile Strength | 58 kg/cm$^2$ |
| Elongation (at break) | 430% |
| Tear Resistance | 18 kg/cm$^2$ |

TABLE II-continued

| Characteristic | AT-40/EVA |
|---|---|
| Compression Set | 10% |

The midsole 20, *20a* is formed by a molding process whereby a core of EVA is encapsulated by PU. In the practice, the core is supported in a mold and the PU is hot/poured into the mold. As indicated in Table II, the PU has a higher specific gravity than indicated in Table I. The higher specific gravity results since the core somewhat restricts the flow of the PU, and more shots are necessary to force the PU around the core. The mold will include a plurality of pins extending toward a parting line of the mold. The pins support the core both along the top and bottom surface. The point of contact of the pins with the core may be within the several regions *22a* and so forth, although the points of contact need not be limited to those regions. Preferably, the core is dopped with a urethane/cement for purposes of obtaining a somewhat better degree of adhesion between what basically are two chemically incompatible materials. In addition to the function of regions *22a*, . . . , the regions also increase the overall surface area of contact between the core and shell to increase the area of adhesion between the components parts of the midsole.

FIGS. 8A, 8B, 8C and 8D illustrate another form of midsole comprised of a single or double density ethylene-vinyl copolymer compression molded from a low density material to a higher density material. Particularly, the midsole is fabricated by compression molding in a mold contoured EVA of low density, heated in order to form the EVA. The compression molding technique, thus, changes the EVA cell structure from low to a higher density. The density or durometer reading (Shore A) of the midsole may be in the range of 25 to 40. The weight of the midsole may be about 56 grams, but the weight could go as high as 80 grams, depending upon the size and width of the midsole. The benefits of compression molding that have been recognized are the formation of a resultant, integral skin around the midsole, and the lower compression set of the EVA without any substantial loss of the bouncy feel and lightweightness. It is believed that these benefits are due to the fact that the cell structure of EVA during the molding process is precompressed. Normally EVA begins to compress from running on a conventional midsole of EVA after approximately 300 miles.

Figure 8A:
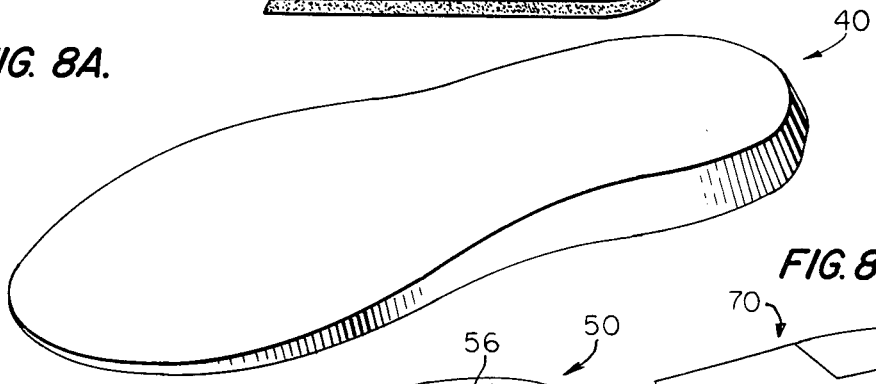
FIG. 8A is a perspective view of a second form of midsole.

FIG. 8A illustrates a midsole 40 of single density which overall is of an external shape similar to that of the midsole of FIG. 2. FIG. 8B, as well as FIGS. 8C and 8D, illustrate further midsoles of like shape.

Midsole 50 (see FIG. 8B) comprises a two-density unit. In this form of midsole, the forepart 52 and the lower heel 54 is formed of a first density EVA. A pad 56 comprising a buffer pad, residing above the lower heel, is formed of a second density EVA. Particularly, the first density may be 40 Shore A, while the second density comprising the buffer pad may be 45 Shore A. The buffer pad may have a thickness of about 4 mm. The densities may vary within ranges as previously discussed.

Figure 8D:
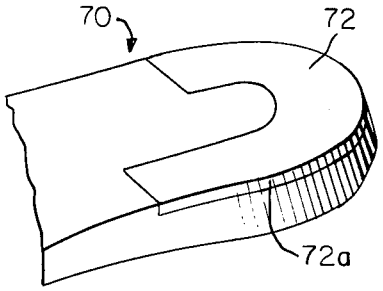
FIG. 8D is a partial perspective of a midsole of FIG. 8B with the buffer pad formed to a horseshoe design.
Figure 8B:
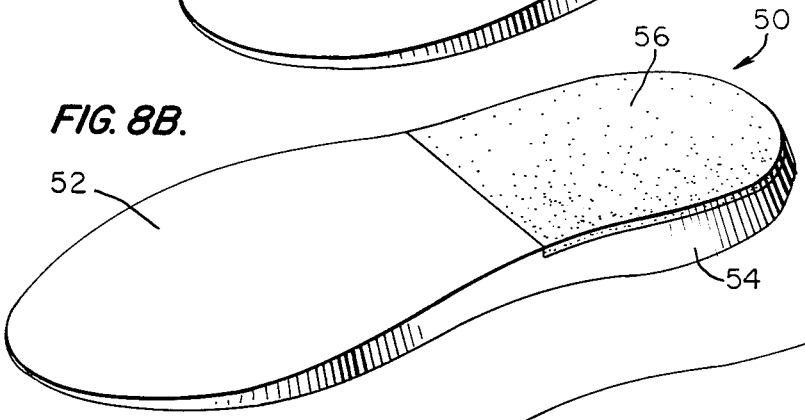
FIG. 8B is a perspective view of a midsole, like the midsole of FIG. 8A, including a buffer pad of a second material.
Figure 8C:
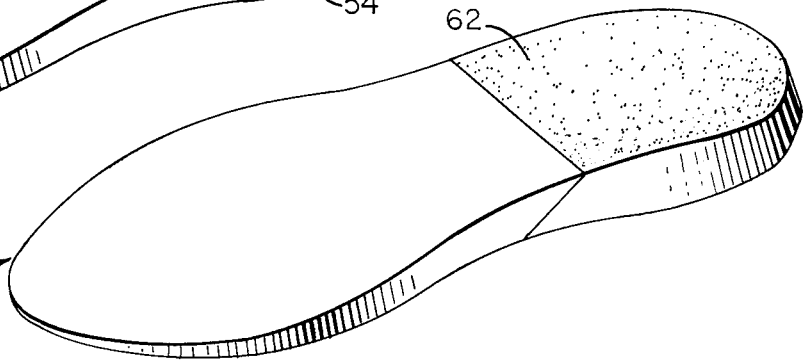
FIG. 8C is a perspective view of a midsole similar to the midsole of FIG. 8B with the buffer pad of the second material extending throughout the heel portion.

Referring to FIG. 8C, the midsole 60 includes a buffer 62 which comprises the entire heel of the midsole. The densities of the EVA within the forepart and heel of the midsole may vary within the ranges discussed. In FIG. 8D, the midsole 70 includes a buffer pad 72 of horseshoe outline, with the longer leg 72*a* disposed along the medial side of the midsole. The buffer pad, and the buffer or buffer pads of the forms of midsole of FIGS. 8B and 8C, help to regulate the compression set achieved in the form of midsole of single density illustrated in FIG. 8A.

In a specific exemplary embodiment, referring to FIG. 8D, the midsole 70 having a buffer pad 72 of horseshoe design has a weight of 80 grams and the following specifications:

TOP

Forepart: 38 Shore A±3
Rear (Horseshoe): 45 Shore A±3

BOTTOM

Forepart: 42 Shore A±3
Rear: 42 Shore A±3

DIMENSIONS

Figure 5:
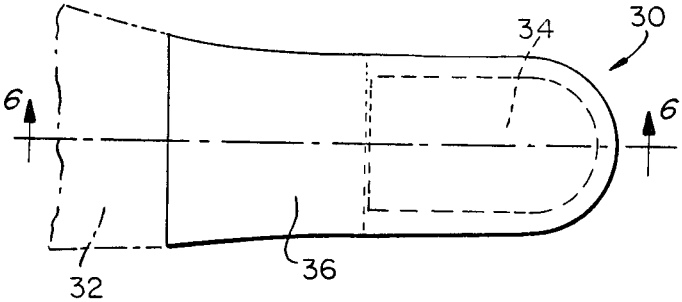
FIG. 5 is a plan view of a wedge for use with a sole unit of an athletic shoe.
Figure 6:
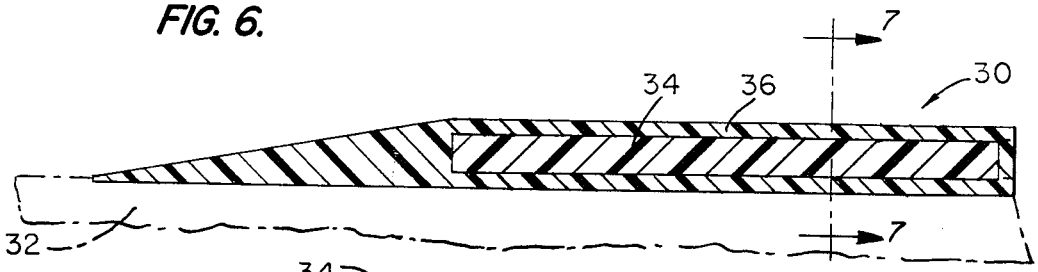
FIG. 6 is a view taken along the line 6—6 in FIG. 5, although in somewhat larger scale.
Figure 7:
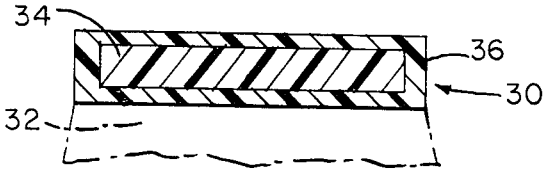
FIG. 7 is a view taken along the line 7—7 in FIG. 6.

Forepart: 11 mm
Rear: 23 mm including 4 mm horseshoe design
Horseshoe: 4 mm×90 mm medial length×75 mm lateral length Referring now to FIGS. 5, 6 and 7, there is illustrated a wedge 30 for use in an athletic shoe including a midsole of conventional construction, or a midsole of the type illustrated in FIG. 8A. In this connection, however, the midsole will be modified somewhat from the form of midsole of FIG. 8A thereby to reduce the height of the heel region to a height, more nearly equal to the height of the forepart. In FIG. 5, and other Figures, the midsole 32 is illustrated by only a very general schematic presentation.

The wedge 30 is formed to a final construction, which may be likened to that of midsole 20, by a process which generally follows the process previously described. To this end, the wedge includes a core 34 and a shell 36, and is of an overall size to accommodate various sizes and widths of the athletic shoes with which it is used.

More particularly, the core 34 is formed of EVA, such as T1350, and the shell 36 is formed of PU such as AT-40. These specific designations are exemplary, and as previously discussed EVA having durometers of 30, 35 and 40 (Shore A) are contemplated. It is also contemplated that the PU may be AT-20. One specific example of wedge construction may be, as follows:

length—about 155 mm
thickness
  heel—about 12 mm
  instep—about 1 mm
taper (length from heel to instep)—about 60 mm
core (thickness)—6 mm±1
shell
  (top and bottom)—3 mm
  (sides and rear)—3 mm The core 34 may be formed to a rectangular body of a length which extends to the break point of the wedge, that is, the point that at which the wedge tapers toward the instep.

The wedge 30 provides both increased shock dispersion in the heel of the shoe and substantially eliminates the compression of the EVA.

Figure 5A:
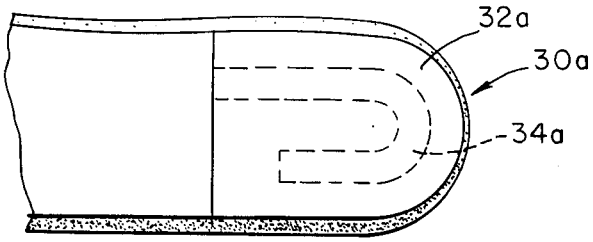
FIG. 5A is a view like that of FIG. 5 illustrating a modified form of wedge.

Referring now to FIG. 5A, there is illustrated a wedge 30*a* including a core 34*a* which is slightly modified from the core of FIG. 5. To this end, core 34*a* is of a horseshoe outline, like that of FIG. 8D. As illustrated, the long leg is located at the break point, and a short leg spaced from the break point. The dimensions of the core may be as previously discussed. The wedge of FIG. 5A is a wedge for a left shoe with the long leg of the horseshoe extending along the medial side of the foot for purposes of increased stability and support for the foot. The process of fabrication of the wedge may follow generally the process of fabrication of the midsole 20. To this end, the core 34 (34*a*) will be supported as a full unit in a mold, allowing, as set out in the specifications, above, for a flow path of about 3 mm around the rear and side walls, as well as over the top and bottom walls. The core may be supported by a plurality of pins, also as previously discussed.

We claim:

1. For use in footwear, a midsole including an integral heel wedge portion, said midsole formed by a core of a first plastic material having a characteristic of springiness, and a shell of a second, different, more dense plastic material molded about said core to at least substantially encapsulate said core within said shell, and wherein the wall of said shell has a thickness of at least about 0.5 mm.

2. The midsole of claim 1 wherein the shell tapers outwardly along a side wall from a top to a bottom surface, and wherein said shell is of a first thickness within the top and bottom rear surfaces which tapers toward the forepart of said midsole.

3. The midsole of claim 2 wherein the angle of taper along said side wall is about 8°.

4. The midsole of claim 2 wherein said shell is of substantially constant thickness within said top rear surface.

5. The midsole of claim 4 wherein said core is exposed along the top forepart surface, and said shell tapers along the bottom surface to a second thickness greater than said first thickness.

6. The midsole of claim 5 wherein said shell tapers from said first thickness along the top surface between said rear surface and said forepart.

7. The midsole of claim 1 wherein said shell is formed by polyurethane having a density of from 20–40 durometer (Shore A).

8. Footwear in the form of an athletic shoe including a sole unit, an upper received on said sole unit including a foot receiving opening, and wherein said sole unit includes an outsole, and a midsole located toward said upper and formed by a core of a first plastic material having a characteristic of springiness, and a shell of a second, different, more dense plastic material molded about said core to at least substantially encapsulate said core within said shell, and wherein the wall of said shell has a thickness of at least about 0.5 mm.

9. The footwear of claim 8 wherein said core is formed of ethylene-vinyl acetate polymer, and said shell is formed of polyurethane, with each material having a density of from 20–40 durometer (Shore A).

10. The footwear of claim 9 further including a stabilizer, said stabilizer supported by said sole unit to surround said upper within the region of the heel to provide support for the upper of the footwear.

11. The footwear of claim 10 wherein said stabilizer is formed of plastic material having a density of about 95 durometer (Shore A).

12. The footwear of claim 11 wherein said stabilizer is formed of polyurethane.

13. The footwear of claim 11 wherein said stabilizer is formed of nylon.

14. Footwear in the form of an athletic shoe including a sole unit, an upper received on said sole unit including a foot receiving opening, and wherein said sole unit includes an outsole, a midsole and a heel wedge located on said midsole toward said upper, said wedge formed by a core of a first plastic material having the characteristics of springiness, and a shell of a second different, more dense plastic material having different characteristics molded about said core to at least substantially encapsulate said core within said shell, and wherein the wall of said shell has a thickness of at least about 0.5 mm.

15. The footwear of claim 14 wherein said shell is formed of polyurethane having a density of from 20–40 durometer (Shore A).

16. The footwear of claim 15 wherein said wedge is of a first thickness within the heel portion of said sole unit and tapers to an edge within an instep region of said sole unit.

17. The footwear of claim 16 wherein said core extends throughout substantially the entire heel portion of said sole unit.

18. The footwear of claim 14 wherein said midsole and heel wedge comprise an integral member, and wherein said core extends throughout.

19. The footwear of claim 14 further including a stabilizer, said stabilizer supported by said sole unit to surround said upper within the region of the heel to provide support for the lasted upper of the footwear.

20. For use in footwear having a sole unit including a midsole, a wedge portion adapted to be supported by said midsole within the heel portion of said sole unit, said wedge formed by a core of a first plastic material having a characteristic of springiness, and a shell of a second, different, more dense plastic material molded about said core to at least substantially encapsulate said core within said shell, and wherein the wall of said shell has a thickness of at least about 0.5 mm.

21. The footwear of claim 20 wherein said core is formed of ethylene vinyl-acetate polymer, and said shell is formed of polyurethane, each having a density of from 20–40 durometer (Shore A).

22. For use in footwear, a midsole formed by a core of a first plastic material having a characteristic of springiness, and a shell of a second, different, more dense plastic material molded about said core to at least substantially encapsulate said core within said shell, and wherein the wall of said shell has a thickness of at least about 0.5 mm.

23. For use in footwear, a heel wedge formed by a core of a first plastic material having a characteristic of springiness, and a shell of a second, different, more dense plastic material molded about said core to at least substantially encapsulate said core within said shell, and wherein the wall of said shell has a thickness of at least about 0.5 mm.

24. For use in footwear, a midsole including an integral heel wedge portion, said midsole formed by a core of ethylene-vinyl acetate polymer having a characteristic of springiness, and a shell of polyurethane which is more dense than said core molded about said core to at least substantially encapsulate said core within said shell, and wherein the wall of said shell has a thickness of at least about 0.5 mm.

25. Footwear in the form of an athletic shoe including a sole unit, an upper received on said sole unit including a foot receiving opening, and wherein said sole unit includes an outsole, a midsole and a heel wedge located on said midsole toward said upper, said wedge formed by a core of ethylene-vinyl acetate polymer having a characteristic of springiness and a shell of polyurethane which is more dense than said core molded about said core to substantially encapsulate said core within said shell, and wherein the wall of said shell has a thickness of at least about 0.5 mm.

* * * * *